US010895834B2

(12) United States Patent
Matsuda et al.

(10) Patent No.: US 10,895,834 B2
(45) Date of Patent: Jan. 19, 2021

(54) FIXING DEVICE, AND IMAGE FORMING APPARATUS

(71) Applicants: Ryohei Matsuda, Kanagawa (JP); Hiroyuki Shimada, Tokyo (JP)

(72) Inventors: Ryohei Matsuda, Kanagawa (JP); Hiroyuki Shimada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/794,976

(22) Filed: Feb. 19, 2020

(65) Prior Publication Data

US 2020/0285180 A1 Sep. 10, 2020

(30) Foreign Application Priority Data

Mar. 6, 2019 (JP) ..... 2019-040605

(51) Int. Cl.
*G03G 15/20* (2006.01)

(52) U.S. Cl.
CPC ..... *G03G 15/2053* (2013.01); *G03G 15/206* (2013.01); *G03G 15/2007* (2013.01); *G03G 15/2064* (2013.01); *G03G 15/2039* (2013.01); *G03G 2215/2035* (2013.01)

(58) Field of Classification Search
CPC ..... G03G 15/2007; G03G 15/2039; G03G 15/2053; G03G 15/206; G03G 15/2064; G03G 2215/2035
See application file for complete search history.

(56) References Cited

U.S. PATENT DOCUMENTS

| | | | | |
|---|---|---|---|---|
| 6,198,901 | B1 * | 3/2001 | Watanabe | G03G 15/2053 399/328 |
| 6,469,279 | B1 * | 10/2002 | Ohtsuka | G03G 15/2064 219/216 |
| 10,025,247 | B2 | 7/2018 | Sawada et al. | |
| 10,082,751 | B2 | 9/2018 | Seto et al. | |
| 10,114,322 | B2 | 10/2018 | Hasegawa et al. | |
| 10,168,653 | B2 | 1/2019 | Matsuda et al. | |
| 10,197,957 | B2 | 2/2019 | Fujimoto et al. | |
| 10,222,732 | B2 | 3/2019 | Seki et al. | |
| 10,281,850 | B2 | 5/2019 | Matsuda et al. | |

(Continued)

FOREIGN PATENT DOCUMENTS

| | | | |
|---|---|---|---|
| JP | 2016-122047 | A | 7/2016 |
| JP | 2018-072551 | A | 5/2018 |
| JP | 6361269 | B2 | 7/2018 |

*Primary Examiner* — David J Bolduc
(74) *Attorney, Agent, or Firm* — Oblon, McClelland, Maier & Neustadt, L.L.P.

(57) ABSTRACT

A fixing device that includes a rotatable endless fixing member, a fixing heat source which heats the fixing member, a pressure member provided on the outside of the fixing member and facing the fixing member, a nip forming member provided inside the fixing member and forming a fixing nip between the fixing member and the pressure member, a nip forming support member for supporting the nip forming member, a high-thermal-conductive member provided between the fixing member and the nip forming member, an adhesive provided between the high-thermal-conductive member and the nip forming member. The thermal conductivity of the adhesive is larger than the thermal conductivity of the nip forming member and lower than the thermal conductivity of the high-thermal-conductive member.

18 Claims, 10 Drawing Sheets

(56) References Cited

U.S. PATENT DOCUMENTS 10,289,037 B2 5/2019 Seki et al.
10,295,937 B2 5/2019 Sawada et al.
10,295,939 B2 5/2019 Yoshinaga et al.
10,317,823 B2 6/2019 Fujimoto et al.
10,331,062 B2 6/2019 Yoshinaga et al.
10,488,788 B2 11/2019 Mitsui et al.
2005/0006370 A1* 1/2005 Suzumi ..... H05B 3/0095 219/216
2008/0273904 A1* 11/2008 Nishida ..... G03G 15/2064 399/333
2009/0067901 A1* 3/2009 Lee ..... G03G 15/2053 399/329
2011/0123238 A1* 5/2011 Kimura ..... G03G 15/2064 399/320
2011/0135358 A1* 6/2011 Kikuchi ..... G03G 15/2064 399/329
2012/0308278 A1* 12/2012 Kikuchi ..... G03G 15/205 399/329
2013/0302072 A1* 11/2013 Taniguchi ..... G03G 15/20 399/328
2014/0138372 A1* 5/2014 Ogura ..... G03G 15/2053 219/216
2015/0093162 A1* 4/2015 Ishida ..... G03G 15/2053 399/328
2015/0139708 A1* 5/2015 Shimura ..... G03G 15/2042 399/329
2015/0153692 A1* 6/2015 Matsubara ..... G03G 15/2042 399/329
2016/0139551 A1* 5/2016 Narahara ..... G03G 15/55 399/33
2016/0246227 A1* 8/2016 Ishimori ..... G03G 15/2032
2017/0343935 A1* 11/2017 Kuriki ..... G03G 15/2053
2018/0217007 A1* 8/2018 Nagatomo ..... G01K 7/223
2018/0267441 A1* 9/2018 Koyanagi ..... G03G 15/2039
2018/0335733 A1* 11/2018 Matsuda ..... G03G 15/2053
2019/0056686 A1* 2/2019 Yagi ..... G03G 15/2053
2019/0243291 A1 8/2019 Matsuda et al.
2019/0250543 A1* 8/2019 Imamiya ..... G03G 15/2039
2019/0286025 A1 9/2019 Yamaguchi et al.
2020/0033777 A1 1/2020 Fujimoto et al.
2020/0166860 A1* 5/2020 Kuwabara ..... G03G 15/04054

* cited by examiner

FIXING DEVICE, AND IMAGE FORMING APPARATUS

CROSS-REFERENCE TO RELATED APPLICATIONS

This application is based on and claims priority pursuant to 35 U.S.C. § 119(a) to Japanese Patent Application No. 2019-040605, filed on Mar. 6, 2019, in the Japan Patent Office, the entire disclosure of which is incorporated herein by reference.

BACKGROUND

Technical Field

Embodiments of the present disclosure generally relate to a fixing device, an image forming apparatus, and a slide member, and more particularly, to a fixing device for fixing a toner image on a recording medium, an image forming apparatus for forming an image on a recording medium, and a slide member for sliding a fixing rotator that fixes an image on a recording medium.

Related Art

Various types of electrophotographic image forming apparatuses are known, including copiers, printers, facsimile machines, and multifunction machines configured to perform two or more of copying, printing, scanning, facsimile, and plotting. Such image forming apparatuses usually form an image on a recording medium according to image data. Specifically, in such image forming apparatuses, for example, a charger uniformly charges a surface of a photoconductor as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

Such a fixing device can further include a slide member applied with lubricant to smoothly slide, e.g., a fixing belt as a fixing rotator.

SUMMARY

In an aspect of the present disclosure, there is provided a fixing device that includes a rotatable endless fixing member, a fixing heat source which heats the fixing member, a pressure member provided on the outside of the fixing member and facing the fixing member, a nip forming member provided inside the fixing member and forming a fixing nip between the fixing member and the pressure member, a nip forming support member for supporting the nip forming member, a high-thermal-conductive member provided between the fixing member and the nip forming member, an adhesive provided between the high-thermal-conductive member and the nip forming member. The thermal conductivity of the adhesive is larger than the thermal conductivity of the nip forming member and lower than the thermal conductivity of the high-thermal-conductive member.

Further, in one embodiment, the adhesive is provided only at both ends outside the maximum sheet passing area in the axial direction of the fixing member.

In one embodiment, the adhesive is provided outside the width of the fixing nip in the circumferential direction of the fixing member and is provided only on the inlet side of the fixing nip.

In one embodiment, the adhesive is provided outside the width of the fixing nip in the circumferential direction of the fixing member, and only on the exit side of the fixing nip.

In one embodiment, the fixing device further includes a fixing heat source, the fixing heat source being a halogen heater having, in an axial direction of the fixing member, a first portion where a winding of a filament is dense and a second portion where the winding of the filament is sparse, wherein a thickness of a first portion of the adhesive facing the first portion of the filament where the winding of the filament is dense is larger than a thickness of a second portion of the adhesive facing the second portion of the filament where the winding of the filament is sparse.

In one embodiment, the adhesive is divided into a plurality of parts in the axial direction of the fixing member.

In one embodiment, the adhesive is divided into a plurality is provided obliquely with respect to the circumferential direction of the fixing member.

Also described is a novel image forming apparatus incorporating the fixing device.

In another embodiment, there is provided a heating device, comprising: a rotatable endless fixing member; a nip forming member provided inside the fixing member and forming a fixing nip between the fixing member and a pressure member, a nip forming support member for supporting the nip forming member, a high-thermal-conductive member provided between the fixing member and the nip forming member, and an adhesive provided between the high-thermal-conductive member and the nip forming member, wherein a thermal conductivity of the adhesive is larger than a thermal conductivity of the nip forming member and is lower than a thermal conductivity of the high-thermal-conductive member.

In another embodiment, there is provided a device to be included in a fixing device having a rotatable endless fixing member, the device comprising: a nip forming member to form a fixing nip between the fixing member and a pressure member; a high-thermal-conductive member provided between the fixing member and the nip forming member; and an adhesive provided between the high-thermal-conductive member and the nip forming member; wherein a thermal conductivity of the adhesive is larger than a thermal conductivity of the nip forming member and is lower than a thermal conductivity of the high-thermal-conductive member.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

DETAILED DESCRIPTION

Figure 1:
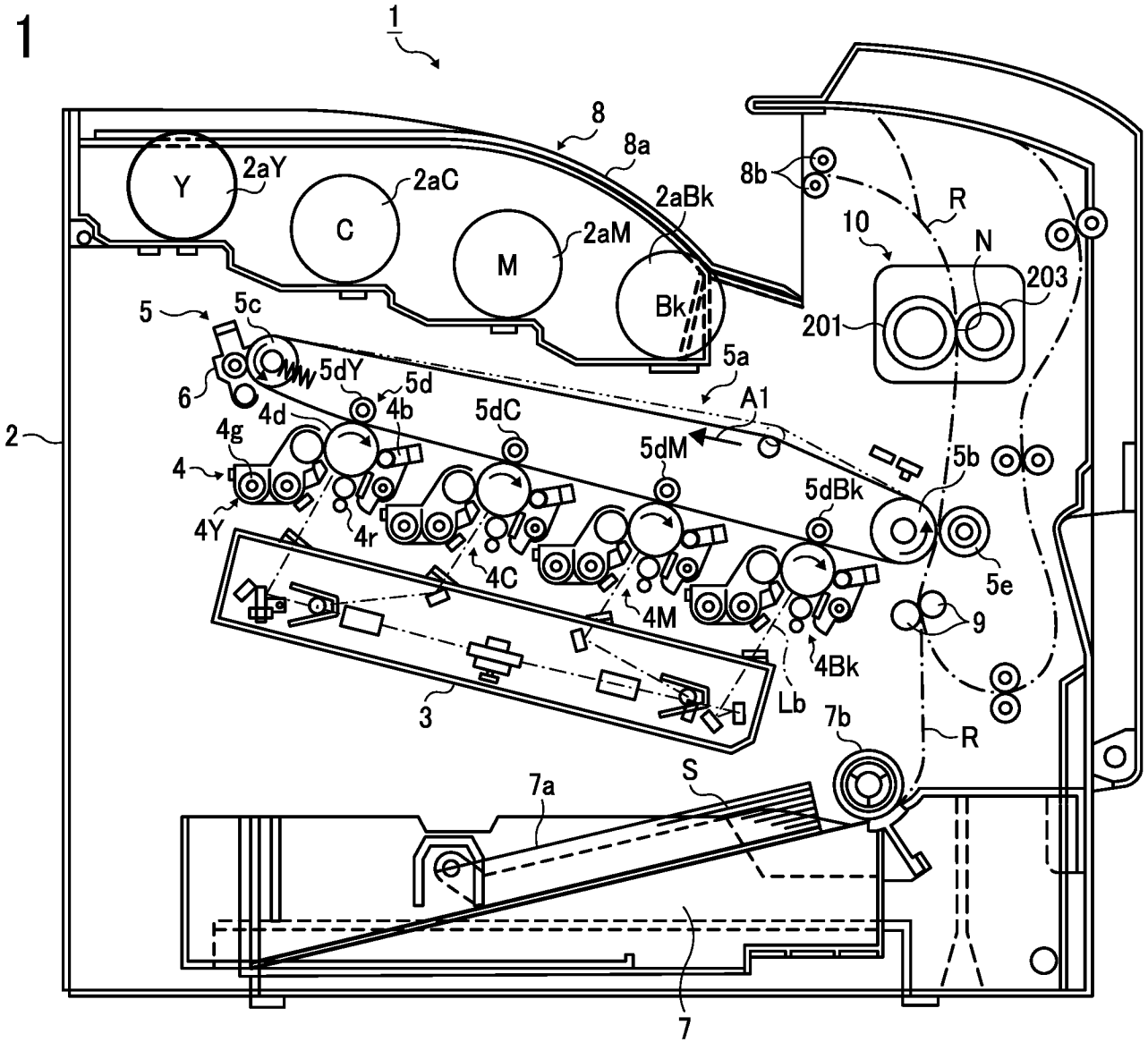
FIG. 1 is a schematic configuration diagram of an entire image forming apparatus according to one embodiment.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of the present disclosure are not necessarily indispensable to the present disclosure. In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and Bk denote colors yellow, cyan, magenta, and black, respectively. To simplify the description, these suffixes can be omitted unless necessary.

Referring now to the drawings, wherein like reference numerals designate identical or corresponding parts throughout the several views, embodiments of the present disclosure are described below.

Initially with reference to FIG. 1, a description is given of an image forming apparatus 1 according to an embodiment of the present disclosure.

FIG. 1 is a schematic view of the image forming apparatus 1.

The image forming apparatus 1 is, for example, a color printer that forms color and monochrome toner images on recording media by electrophotography.

As illustrated in FIG. 1, the image forming apparatus 1 includes a housing 2, an optical writing device 3, a process unit 4 as an image forming device, a transfer device 5, a belt cleaning device 6, a sheet feeding device 7, a sheet ejection unit 8, a registration roller pair 9, and a fixing device 10.

The image forming apparatus 1 has a tandem configuration, in which photoconductive drums 4*d* are arranged side by side, as image bearers to respectively bear toner images of yellow (Y), cyan (C), magenta (M), and black (Bk). It is to be noted that the image forming apparatus according to one embodiment of the present disclosure is not limited to such a tandem image forming apparatus, but can have another configuration. Additionally, the image forming apparatus according to one embodiment of the present disclosure is not limited to the color image forming apparatus 1, but can be another type of image forming apparatus. For example, the image forming apparatus can be a copier, a facsimile machine, or a multifunction peripheral having one or more capabilities of such devices.

The housing 2 accommodates various components. Also, inside the housing 2 is a conveyance passage R, defined by internal components of the image forming apparatus 1, along which a sheet S as a recording medium is conveyed from the sheet feeding device 7 to the sheet ejection unit 8.

The housing 2 also accommodates, e.g., toner bottles 2*a*Y, 2*a*C, 2*a*M, and 2*a*Bk below the sheet ejection unit 8. The removable toner bottles 2*a*Y, 2*a*C, 2*a*M, and 2*a*Bk contain fresh toner of the colors yellow, cyan, magenta, and black, respectively, and are mounted in the housing 2. The housing 2 also accommodates a waste toner container having an inlet in communication with a toner conveyance tube. The waste toner container receives waste toner conveyed through the toner conveyance tube.

The optical writing device 3 includes a semiconductor laser as a light source, a coupling lens, an f-θ lens, a toroidal lens, a deflection mirror, and a polygon mirror. The optical writing device 3 emits laser beams Lb onto the respective photoconductive drums 4*d* included in the process unit 4, according to yellow, cyan, magenta, and black image data, to form electrostatic latent images on the respective photoconductive drums 4*d*. The yellow, cyan, magenta, and black image data are single-color data, into which a desired full-color image data is decomposed.

The process unit 4 is constituted of four sub-process units 4Y, 4C, 4M, and 4Bk to respectively form toner images of yellow, cyan, magenta, and black. For example, the sub-process unit 4Y includes the photoconductive drum 4*d*. The sub-process unit 4Y also includes a charging roller 4*r*, a developing device 4*g*, and a cleaning blade 4*b* surrounding the photoconductive drum 4*d*. In the sub-process unit 4Y, charging, optical writing, developing, transfer, cleaning, and discharging processes are performed on the photoconductive drum 4*d* in this order.

Specifically, at first, the charging roller 4*r* charges an outer circumferential surface of the photoconductive drum 4*d* electrostatically. The optical writing device 3 conducts optical writing on the charged outer circumferential surface of the photoconductive drum 4*d*, forming an electrostatic latent image constituted of electrostatic patterns on the photoconductive drum 4*d*. Then, the developing device 4*g* adheres yellow toner supplied from the toner bottle 2*a*Y to the electrostatic latent image formed on the photoconductive drum 4*d*, thereby developing the electrostatic latent image with the yellow toner into a visible yellow toner image. The yellow toner image is primarily transferred onto the transfer device 5. Thereafter, the cleaning blade 4*b* removes residual toner that failed to be transferred onto the transfer device 5 and therefore is remaining on the photoconductive drum 4*d*, from the photoconductive drum 4*d*, rendering the photoconductive drum 4*d* to be ready for a next primary transfer. Finally, the discharging process is performed to remove residual static electricity from the photoconductive drum 4*d*.

The photoconductive drum 4*d* is a tube including a surface photoconductive layer made of organic and inorganic photoconductors. The charging roller 4*r* is disposed in proximity to the photoconductive drum 4*d* to charge the photoconductive drum 4*d* with discharge between the charging roller 4*r* and the photoconductive drum 4*d*.

The developing device 4*g* includes a supply section for supplying yellow toner to the photoconductive drum 4*d* and a developing section for adhering yellow toner to the photoconductive drum 4*d*. The cleaning blade 4*b* includes an elastic band made of, e.g., rubber, and a toner remover such as a brush. The removable developing device 4*g* is mounted in the housing 2.

Each of the sub-process units 4C, 4M, and 4Bk has a configuration equivalent to the configuration of the sub-process unit 4Y described above. Specifically, the sub-process units 4C, 4M, and 4Bk form toner images of cyan, magenta, and black to be primarily transferred onto the transfer device 5, respectively.

The transfer device 5 includes a transfer belt 5*a*, a driving roller 5*b*, a driven roller 5*c*, four primary transfer rollers 5*d*, and a secondary transfer roller 5*e*. The transfer belt 5*a* is an endless belt entrained around the driving roller 5*b* and the driven roller 5*c*. As the driving roller 5*b* and the driven roller 5*c* rotates, the transfer belt 5*a* rotates, or moves in cycles, in a rotational direction A1.

The four primary transfer rollers 5*d* are primary transfer rollers 5*d*Y, 5*d*C, 5*d*M, and 5*d*Bk pressed against the photoconductive drums 4*d* of the sub-process units 4Y, 4C, 4M, and 4Bk via the transfer belt 5*a*, respectively. Thus, the transfer belt 5*a* contacts the sub-process units 4Y, 4C, 4M, and 4Bk, forming four areas of contact, herein called primary transfer nips, between the transfer belt 5*a* and the sub-process units 4Y, 4C, 4M, and 4Bk, respectively. The secondary transfer roller 5*e* presses an outer circumferential surface of the transfer belt 5*a*, thereby pressing against the driving roller 5*b* via the transfer belt 5*a*. Thus, an area of contact, herein called a secondary transfer nip, is formed between the secondary transfer roller 5*e* and the transfer belt 5*a*.

The belt cleaning device 6 is disposed between the secondary transfer nip and the sub-process unit 4Y in the rotational direction A1 of the transfer belt 5*a*. The belt cleaning device 6 includes a toner remover and the toner conveyance tube. The toner remover removes residual toner that failed to be transferred onto the sheet S at the secondary transfer nip and therefore remains on the outer circumferential surface of the transfer belt 5*a*, from the transfer belt 5*a*. The residual toner thus removed is conveyed as waste toner through the toner conveyance tube to the waste toner container.

The sheet feeding device 7 is disposed in a lower portion of the housing 2. The sheet feeding device 7 includes a sheet tray 7*a* and a sheet feeding roller 7*b*. The sheet tray 7*a* holds a plurality of sheets S. The sheet feeding roller 7*b* picks up an uppermost sheet S from the plurality of sheets S on the sheet tray 7*a*, and feeds the uppermost sheet S to the conveyance passage R.

The sheet ejection unit 8 is disposed above the optical writing device 3 and atop the housing 2. The sheet ejection unit 8 includes a sheet ejection tray 8*a* and a sheet ejection roller pair 8*b*. The sheet ejection roller pair 8*b* ejects a sheet S bearing an image onto the sheet ejection tray 8*a*. Thus, the sheets S ejected from the conveyance passage R by the sheet ejection roller pair 8*b* rest one atop another on the sheet ejection tray 8*a*.

The registration roller pair 9 adjusts conveyance of the sheet S along the conveyance passage R, after the sheet S is fed by the sheet feeding roller 7*b* of the sheet feeding device 7.

For example, a registration sensor is interposed between the sheet feeding roller 7*b* and the registration roller pair 9 on the conveyance passage R inside the housing 2 to detect a leading edge of the sheet S conveyed along the conveyance passage R. When a predetermined time elapses after the registration sensor detects the leading edge of the sheet S, the registration roller pair 9 interrupts rotation to temporarily halt the sheet S that comes into contact with the registration roller pair 9. The registration roller pair 9 is timed to resume rotation while sandwiching the sheet S to convey the sheet S to the secondary transfer nip. For example, the registration roller pair 9 resumes rotation in synchronization with a composite color toner image, constituted of the toner images of yellow, cyan, magenta, and black superimposed one atop another on the transfer belt 5*a*, reaching the secondary transfer nip as the transfer belt 5*a* rotates in the rotation direction A1.

After the composite color toner image is transferred from the transfer belt 5*a* to the sheet S at the secondary transfer nip, the sheet S is conveyed to the fixing device 10. The fixing device 10 includes, e.g., a rotatable fixing belt 201 and a pressure roller 203 pressing against an outer circumferential surface of the fixing belt 201. The toner image is fixed onto the sheet S under heat and pressure while the sheet S is conveyed through an area of contact, herein called a fixing nip N, between the fixing belt 201 and the pressure roller 203. As the sheet S bearing the fixed toner image is discharged from the fixing nip N, the sheet S separates from the fixing belt 201 and is conveyed to the sheet ejection roller pair 8*b* along the conveyance passage R.

Figure 2:
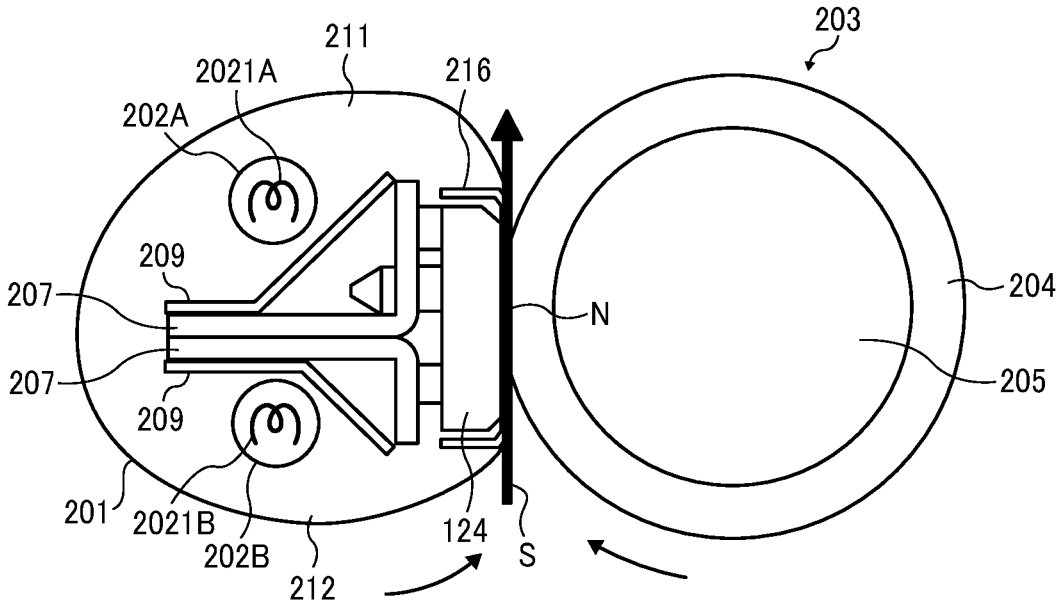
FIG. 2 is a schematic configuration view of a fixing device.
Figure 3:
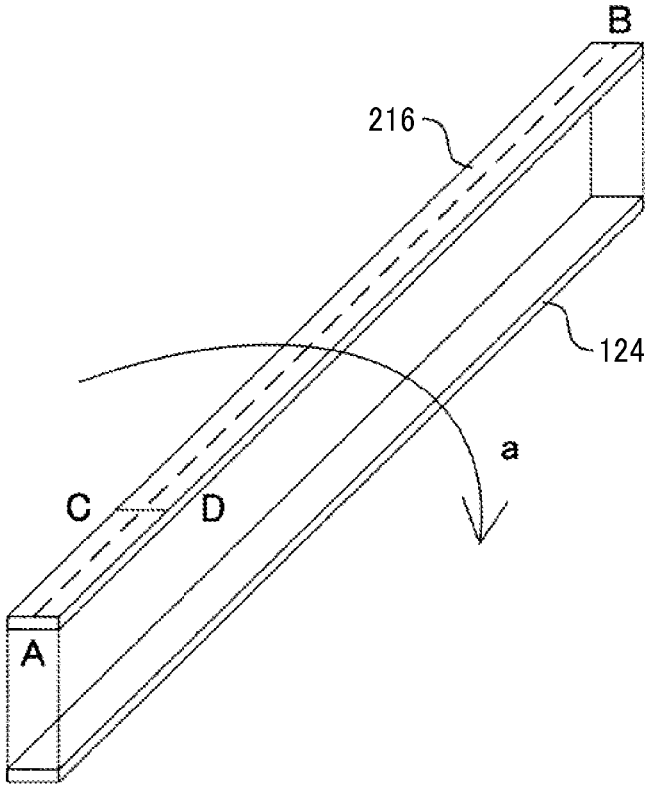
FIG. 3 is the perspective schematic in an example of a heat equalizing member and a nip formation member.

Referring now to FIGS. 2 and 3, a detailed description is given of the fixing device 10 incorporated in the image forming apparatus 1 described above.

FIG. 2 is a schematic cross-sectional view of the fixing device 10. FIG. 3 is a partially enlarged cross-sectional view of the fixing device 10 of FIG. 2.

As illustrated in FIG. 2, the fixing device 10 includes the fixing belt 201 as a fixing rotator, the pressure roller 203 as a pressure rotator, heaters 202A and 202B having filaments 2021A and 2021B, respectively, a nip formation pad 124, a high-thermal-conductive member 216, support members 207, and reflectors 209. The fixing device 10 includes a controller to control temperature of the various components, such as a fixing temperature on the fixing belt 201. The fixing belt 201 and the components disposed inside a loop formed by the fixing belt 201, that is, the heaters 202A and 202B, the nip formation pad 124, the high-thermal-conductive member 216, the support member 207, and the reflectors 209 can constitute a belt unit detachably coupled to the pressure roller 203.

Each support member (stay) 207 has a shape having an upright portion standing upright on the side opposite to the nip N side. Halogen heaters 202A and 202B as fixing heat sources are arranged with the upright portion therebetween. The fixing belt 201 is directly heated by radiant heat from the inner surface side by the halogen heaters 202A and 202B. Each support member (stay) 207 is a member for supporting the nip forming member 124 and is provided inside the fixing belt 201. Each support member 207 prevents the nip forming member 124 that receives pressure from the pressure roller 203 from bending, and can obtain a uniform nip width in the axial direction.

The reflective members 209 are provided between the halogen heaters 202A or 202B and the support members (stays) 207. Thereby, useless energy consumption due to the support member (stay) 207 being heated by radiant heat from the halogen heater 202A or 202B or the like is suppressed. Here, instead of providing the reflecting member 209, the same effect can be obtained even if the surface of the support member (stay) 207 is heat-insulated or mirror-finished.

The pressure roller 203 is constructed of a roller 205 as a cored bar. A driver, disposed inside the housing 2, outputs a driving force to rotate the pressure roller 203. The driver is constructed of, e.g., a driving section such as a motor, and a reduction section such as a reduction gear. A biasing assembly presses the pressure roller 203 against the fixing belt 201. At this time, the pressure roller 203 is pressed and elastically deformed to define a part of the fixing nip N.

The roller 205 is made of a material having a desired mechanical strength and exhibiting an enhanced thermal conductivity. Specifically, the roller 205 is made of metal such as carbon steel and aluminum (Al) and formed as a solid bar. The carbon steel can include, e.g., carbon steel for machine structural use or a carbon steel bar for a general structural purpose. Alternatively, the roller 205 can be formed as a hollow cylinder inside which a heat source such as a halogen heater is situated. An elastic layer 204 is provided around the roller 205. The elastic layer may made of silicone rubber and a thickness of, for example, 3.5 mm. Thus, the heat source heats the sheet S passing through the fixing nip N via the roller 205, The heaters 202A and 202B are secured to the housing 2 inside the loop formed by the fixing belt 201, that is, on an inner circumferential side of the fixing belt 201, isolated from the fixing belt 201. The controller described above controls power supply to the heaters 202A and 202B.

The nip formation pad 124 and the high-thermal-conductive member 216 compose a nip forming member.

The nip formation pad 124 is made of a material exhibiting enhanced rigidity for example, a Liquid Crystal Polymer (LCP).

The high-thermal-conductive member 216 is a high thermal conductive member that is arranged so as to cover a surface of the nip forming pad 124 on the nip side, and a metal having high thermal conductivity such as copper (Cu) and aluminum (Al) can be suitably used. In one embodiment, copper (Cu) is used.

By arranging the high-thermal-conductive member 216 that is of a metallic material having high thermal conductivity such as copper (Cu) and aluminum (Al) in a paper width direction, for example, even if the temperature of the fixing member rises in a non-paper-passing region when small-sized sheets are continuously fed, heat can be effectively shifted and scattered in the longitudinal direction (paper width direction), and a so-called end temperature rise can be suppressed.

The nip formation pad 124 is elongated in the width direction of the sheet S passing through the fixing nip N illustrated in FIGS. 2 and 3. The nip formation pad 124 has a substantially rectangular cross-section perpendicular to the width direction of the sheet S. The nip formation pad 124 is disposed inside the loop formed by the fixing belt 201 and opposite the pressure roller 203 to form the fixing nip N between the fixing belt 201 and the pressure roller 203.

In one embodiment, the fixing nip N is planar in cross-section. Alternatively, the fixing nip N can be concave or curved in cross-section with respect to the pressure roller 203. If the fixing nip N is concave, the concave fixing nip N directs a leading edge of the sheet S toward the pressure roller 203, facilitating separation of the sheet S from the fixing nip N and therefore preventing the sheet S from being jammed between the fixing belt 201 and the pressure roller 203. To enhance an effect of the high-thermal-conductive member 216, a thickness of the high-thermal-conductive member 216 is changed in the longitudinal direction by shaving a center portion. However, changing the thickness of the high-thermal-conductive member 216 can increase production cost.

Figure 4A:
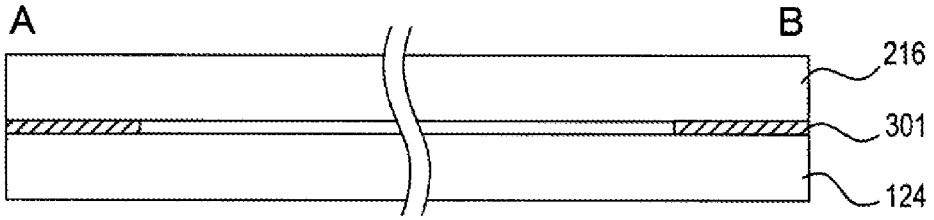
FIG. 4A is a cross-sectional view taken along line AB in FIG. 3 according to one embodiment.
Figure 4B:
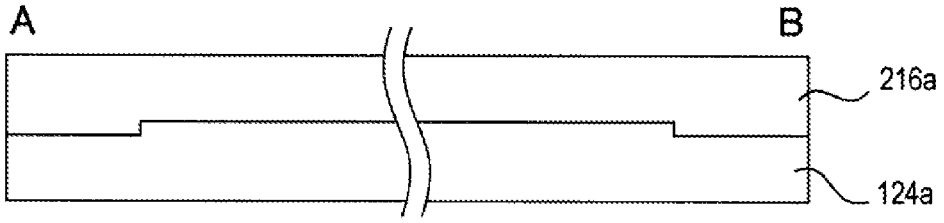
FIG. 4B is a cross-sectional view taken along line AB in FIG. 3 according to the background art.

Hence, in one embodiment, as shown in FIGS. 4A and 4B, an adhesive 301 is provided between the nip formation pad 124 and the high-thermal-conductive member 216. The adhesive 301 has a higher thermal conductivity than the nip formation pad 124 and a lower thermal conductivity than the high-thermal-conductive member 216.

Because the adhesive 301 has a higher thermal conductivity than the nip formation pad 124 and a lower thermal conductivity than the high-thermal-conductive member 216, the adhesion 301 also has a function of thermal conduction. Also, because of the use of the adhesive, it is easy to change the thermal conductivity in the longitudinal direction, and avoid the end temperature rise.

The adhesive 301 is, for example, double-sided metal tape, double-sided transparent resin tape, or double-sided fabric tape. Metal such as copper (Cu) and aluminum (Al) can be used for the metal tape.

Figure 5A:
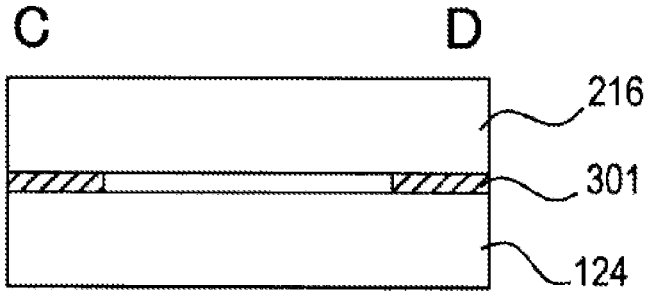
FIG. 5A is a cross-sectional view taken along line C-D in FIG. 3 according to the embodiment.
Figure 5B:
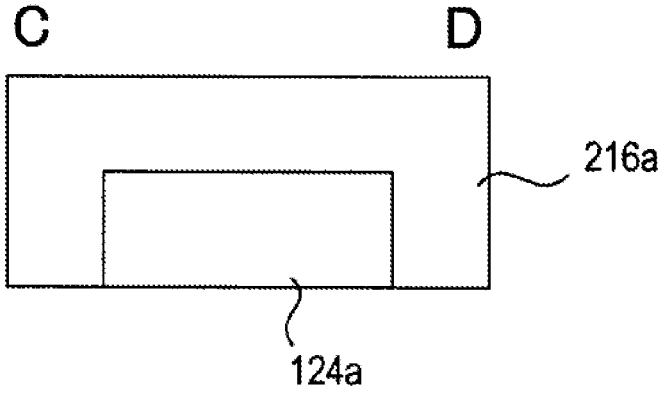
FIG. 5B is a cross-sectional view taken along line C-D in FIG. 3 according to the background art.

FIG. 5A shows a C-D profile (circumferential direction) of FIG. 3, while FIG. 5B shows a conventional C-D profile (circumferential direction).

As shown in FIG. 5B, in the case of adjusting the temperature distribution in to the circumferential direction of the fixing belt, in the conventional system, a process of increasing the thickness on the circumferential end side of the heat equalizing member 216*a* or a process of cutting the center side is needed. In addition, it is necessary to perform fitting to the nip forming member 124*a*.

In contrast, as shown FIG. 5A, because this embodiment uses the adhesive 301 instead of changing the thickness of the high-thermal-conductive member 216, the end temperature rise is easily restrained.

Figure 6A:
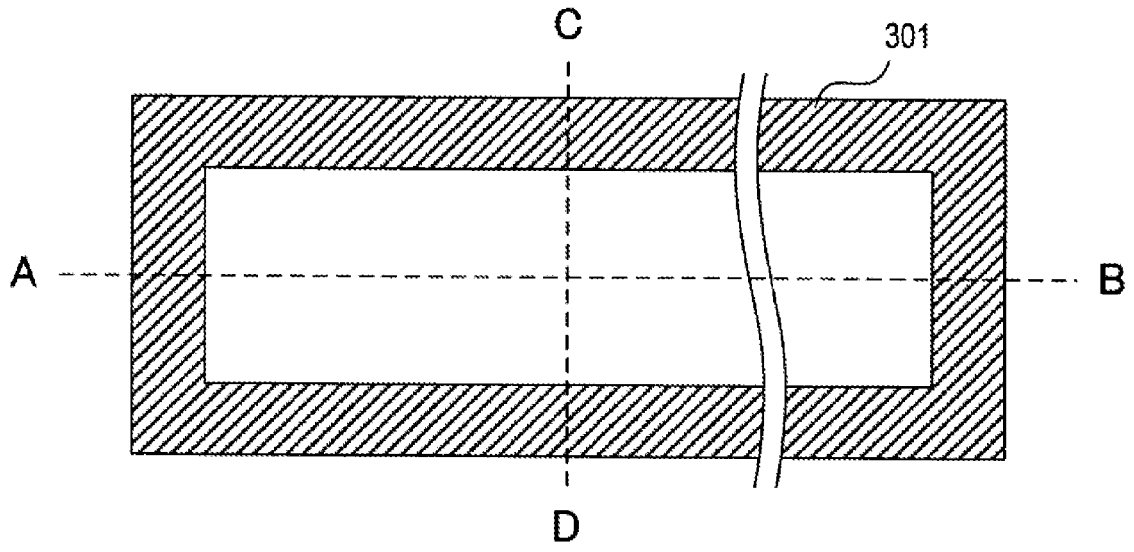
FIGS. 6A and 6B are plane schematic diagrams of the high-thermal-conductive member in FIG. 3.
Figure 6B:
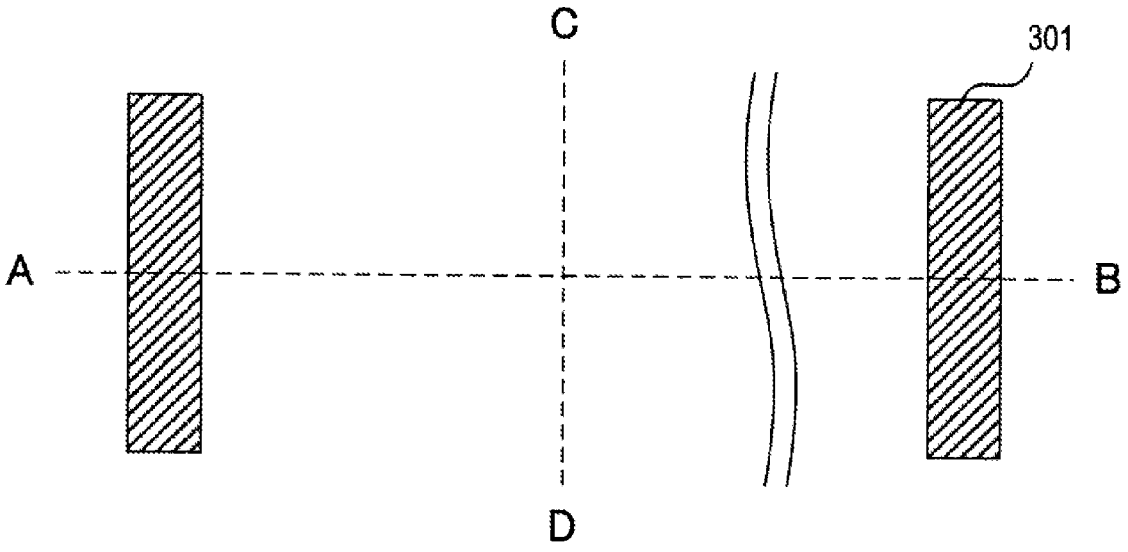

As shown in FIG. 6A, the adhesive 301 can be provided at an end of the longitudinal direction and at an end of the cross-section. As shown in FIG. 6B, the adhesive 301 can be provided only at an end of the longitudinal direction. Each of the embodiments in FIG. 6A and FIG. 6B has the temperature effect discussed above.

Second Embodiment

In one embodiment, the adhesive 301 is provided only at both ends outside the maximum sheet passing area in the axial direction of the fixing belt (fixing member).

Figure 7A:
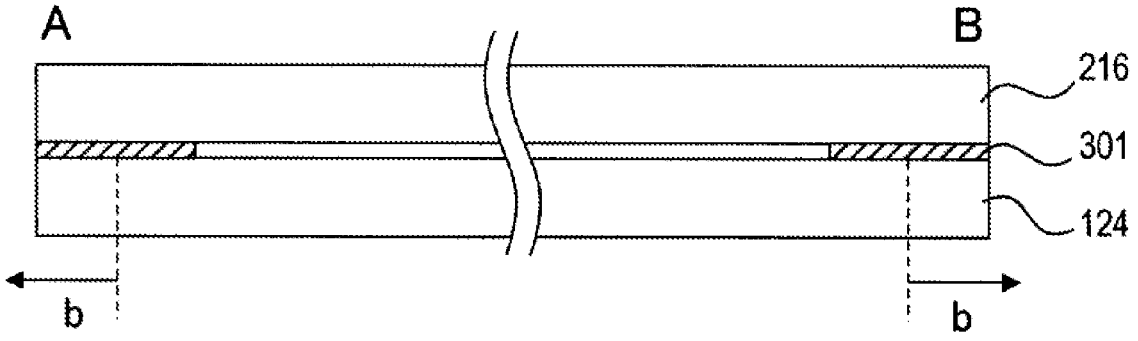
FIG. 7A is an AB sectional view of FIG. 3 in one embodiment.
Figure 7B:
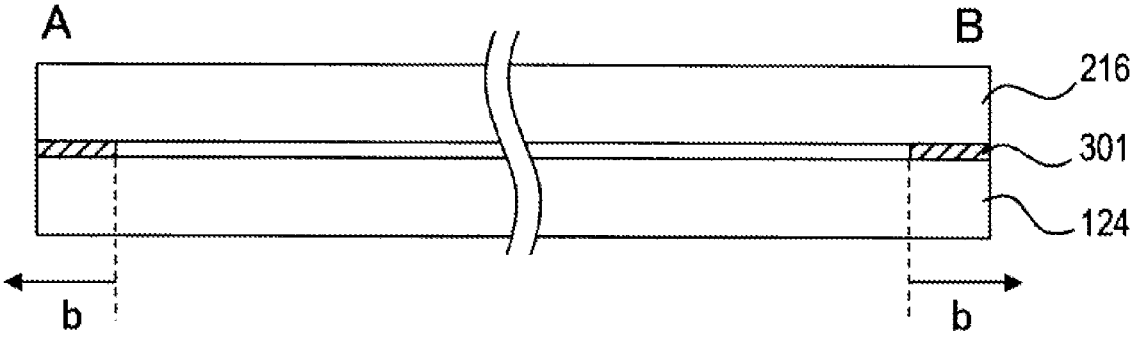
FIG. 7B is an AB sectional view of FIG. 3 in another embodiment.

FIG. 7A shows a longitudinal direction of the high-thermal-conductive member 216 and the nip formation pad 124. FIGS. 7A and 7B are A-B cross sections of FIG. 3. The broken line indicates the maximum passing area and the arrow b indicates an area outside of the maximum passing area.

In FIG. 7A, adhesive members 301 are provided at both ends outside the maximum sheet passing area and also within the maximum sheet passing area, whereas in FIG. 7B, the adhesive members 301 are provided only at both ends outside the maximum sheet passing area. In FIG. 7A, a temperature uniformity can be improved by increasing the thickness of the heat equalizing member in the portion where the temperature rise level is large in the axial direction, but, on the other hand, at the position at which the heat equalizing member is thickened, the heat capacity increases. As a result, the heat absorption amount from the fixing belt 201 to a thin portion becomes large, the temperature rising rate can be slowed, and the image forming time can be long.

On the other hand, by setting the location where the thickness of the heat equalizing member is increased outside the maximum sheet passing width in the axial direction, it is possible to suppress the temperature rise in the non-sheet passing portion (outside the maximum sheet passing area) at the time of continuous sheet passing of the widest sheet and the near-widest-size sheet, and prevent a decrease in the temperature rising rate in the sheet passing area.

Third Embodiment

Next, another embodiment of the fixing device according to the present disclosure will be described. Descriptions of matters similar to those in the above embodiments will be omitted.

Figure 8A:
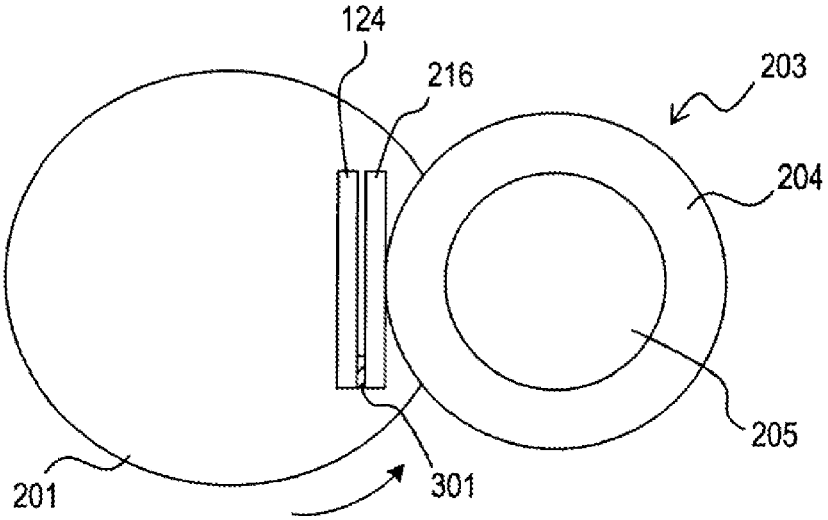
FIG. 8A is a schematic sectional view of a fixing device according to another embodiment.
Figure 8B:
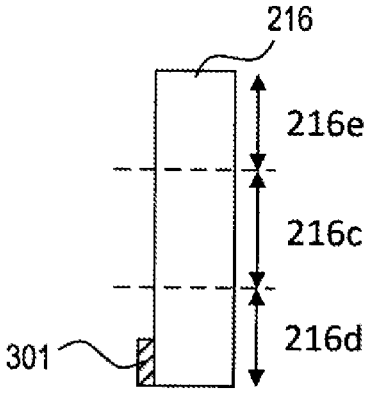
FIG. 8B is a principal part schematic cross-sectional view of a fixing device according to another embodiment.

The present embodiment will be described with reference to FIGS. 8A and 8B. FIG. 8A shows a schematic cross-sectional view of FIG. 2, and the main parts are illustrated. FIG. 8B is a view for explaining the nip portion of the high-thermal-conductive member 216 in FIG. 8A and the outside of the nip portion. As shown in FIG. 8B, a nip portion 216*c* is shown as the nip portion. Outside the nip, the nip outside portions 216*d* and 216*e* is shown. Here, the nip portion 216*d* is on the nip to inlet side and the nip portion 216*e* is on the nip outlet side.

As illustrated, in the present embodiment, the adhesive member 301 is provided on the nip portion 216*d*. As described above, the location where the adhesive member 301 is provided corresponds to the increase in thickness of the high-thermal-conductive member 216, and the heat capacity of the high-thermal-conductive member 216 increases as the thickness of the high-thermal-conductive member 216 increases. In such a location, the heat absorption amount from the fixing belt can be large, and the temperature rising rate can be slow.

On the other hand, according to the present embodiment, in order to suppress heat absorption from the fixing belt 201, as shown in FIGS. 7A and 7B the adhesive member 301 is provided at a nip inlet side of the area outside the nip where the fixing belt and the high-thermal-conductive member 216 are not in contact with each other. Thus, the thickness of the portion at which the temperature rise of the fixing belt is suppressed by the adhesive member 301 can be increased, and the heat absorption from the fixing belt 201 can be suppressed. Therefore, the endothermic temperature rising speed can be secured by providing the pressure-sensitive adhesive member 301, so as to avoid the location where the heat is directly transferred from the fixing belt.

Fourth Embodiment

Next, another embodiment of the fixing device according to the present disclosure will be described. Descriptions of matters similar to those in the above embodiments will be omitted.

In the present embodiment, the adhesive member 301 is provided outside the width of the fixing nip in the circumferential direction of the fixing member 201, and is provided only on the exit side of the fixing nip.

Figure 9A:
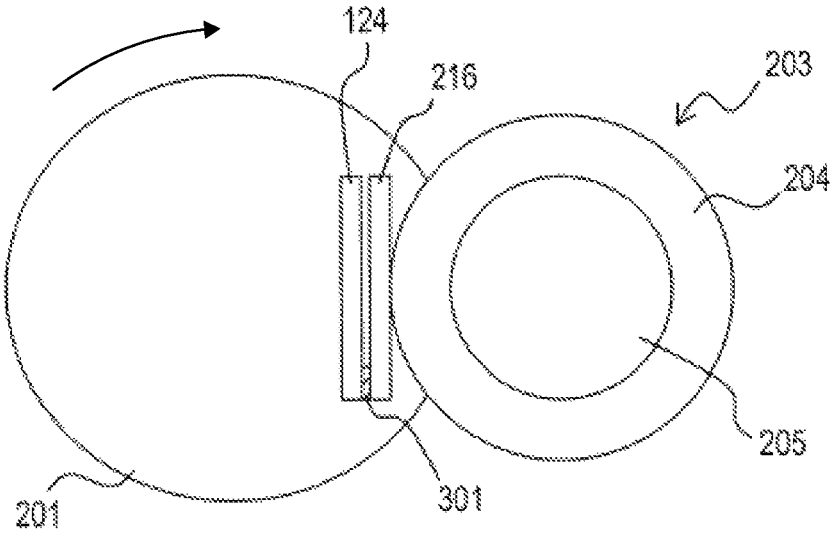
FIG. 9A is a schematic sectional view of a fixing device according to another embodiment.
Figure 9B:
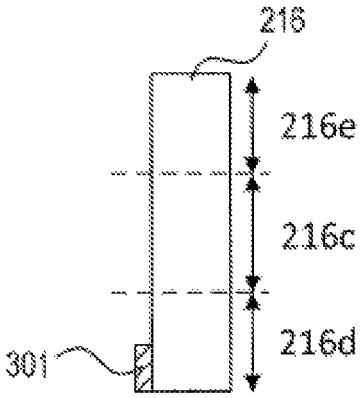
FIG. 9B is a principal part schematic cross-sectional view of a fixing device according to another embodiment.

The present embodiment will be described with reference to FIGS. 9A and 9B. FIG. 9A is a schematic cross-sectional view similar to FIG. 8A, and the rotation direction of the fixing belt 201 is different from FIG. 8A. The nipping portion and the portion outside the nipping portion will be described with reference to FIG. 9B. The nipping portion 216*e* is on the nip inlet side, and the nipping portion 216*d* is on the nip outlet side.

In the present embodiment, the adhesive member 301 is provided on the outside of the nip portion 216*d* on the nip exit side. As in the third embodiment, the thickness of the portion where the temperature rise of the fixing belt is suppressed by the adhesive member can be increased, and the heat absorption from the fixing belt can be suppressed. Therefore, the endothermic temperature rising speed can be secured by providing the pressure-sensitive adhesive member so as to avoid the location where the heat is directly transferred from the fixing belt.

Fifth Embodiment

Next, another embodiment of the fixing device according to the present disclosure will be described. Descriptions of matters similar to those in the above embodiments will be omitted.

In the present embodiment, the fixing heat source is a halogen heater having portions where the winding of the filament 2021A (or 2021B) is dense and portions where the winding is sparse in the axial direction of the fixing member. Further, in the axial direction of the fixing member 201, the adhesive member 301 is constructed to so that the thickness of the portion facing the portion where the winding of the filament is dense is larger than the thickness of the portion facing the portion where the winding of the filament is sparse.

Figure 10:
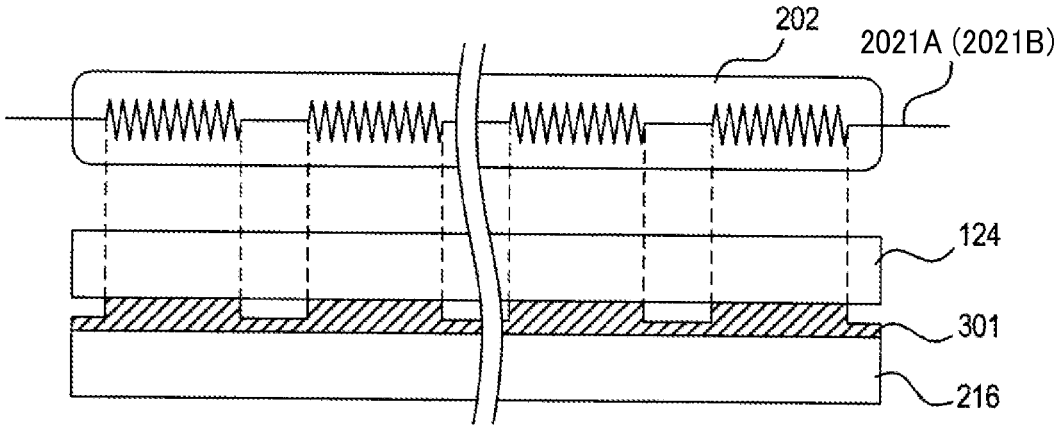
FIG. 10 is schematic view of a fixing heat source and an adhesive member according to another embodiment.

The present embodiment will be described with reference to FIG. 10. In FIG. 10, a halogen heater 202, a filament 2021A (2021B), a nip forming member 124, an adhesive member 301, and a heat equalizing member 216 are illustrated. FIG. 10 is a view showing the positional relationship between the filament 2021A (2021B) of the halogen heater 202 (fixing heat source) and the adhesive member 301 in the present embodiment. The portions indicated by broken lines indicate the portions where the winding of the filament is dense, and the portions between the broken line and the broken line indicate the portions where the winding of the filament is sparse.

When the fixing heat source is a halogen heater, the temperature of the dense portion of the filament is higher than that of the sparse portion of the filament, and the temperature distribution in the axial direction of the fixing member is uneven. Therefore, with the adhesive member 301 in the present embodiment, the thickness of the portion opposed to the portion where the winding of the filament 2021 A of the halogen heater 202 is increased, and the thickness of the portion opposed to the portion where the winding of the filament of the halogen heater is decreased. Thereby, the thickness of the high-thermal-conductive member 216 becomes a thickness corresponding to the sparseness/denseness of the filament, and it is possible to suppress the variation of the temperature distribution in the axial direction. Note that "opposed to" indicates that the portion where the filaments are dense or sparse and the portion where the adhesive member is thick or thin correspond to the direction perpendicular to the axial direction of the fixing member.

Sixth Embodiment

Next, another embodiment of the fixing device according to the present disclosure will be described. Descriptions of matters similar to those in the above embodiments will be omitted.

The adhesive member 301 of the present embodiment is divided into a plurality of parts in the axial direction of the fixing member. Further, in this embodiment, each of the parts is arranged at an angle to a longitudinal direction and a circumferential direction of the fixing member 201. In other words, each of the parts is arranged obliquely to the circumferential direction of the fixing member 201. The inlet side of the fixing nip of the fixing member is provided on the axial end side, and the exit side of the fixing nip is on the axial center side of the fixing member 201.

Figure 11A:
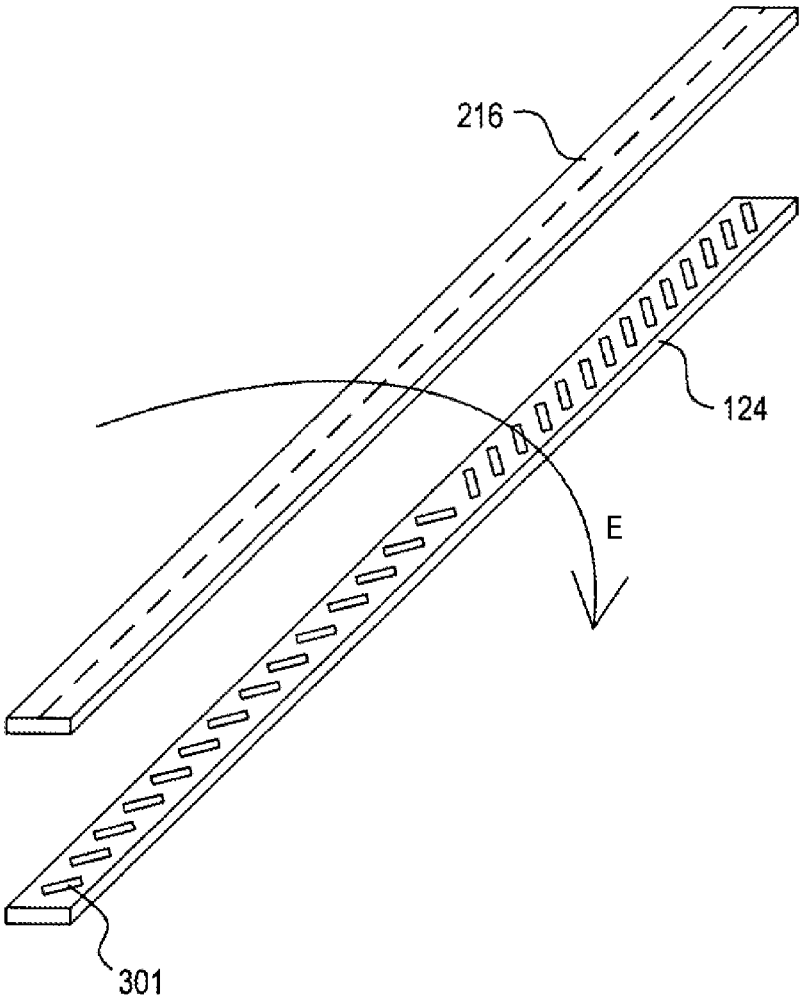
FIG. 11A is a schematic perspective view of a heat equalizing member and a nip forming member according to another embodiment.
Figure 11B:
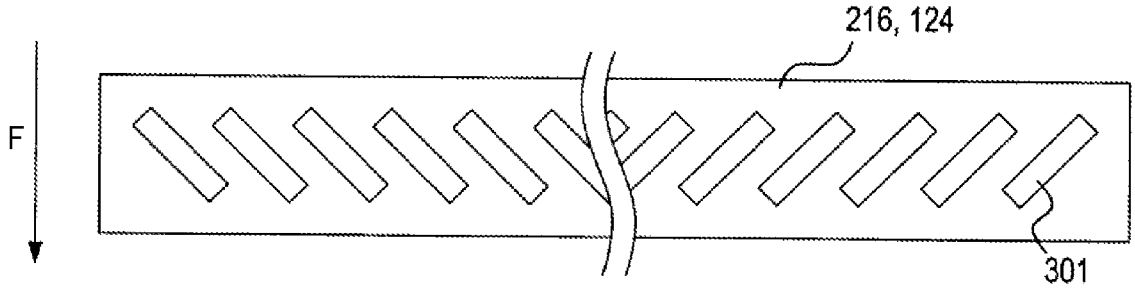
FIG. 11B is a schematic plan view of a heat equalizing member and a nip forming member according to another embodiment.

The present embodiment will be described with reference to FIGS. 11A and 11B. FIG. 11A schematically shows a perspective view of the heat equalizing member 216 and the nip forming member 124 in the present embodiment. FIG. 11B is a view for explaining the arrangement of the adhesive member 301 in FIG. 11A, and is a schematic plan view when viewed from the thickness direction of the heat equalizing member 216 and the nip forming member 124.

In the present embodiment, the adhesive member 301 is divided into a plurality of parts arranged at an angle with respect to a longitudinal direction and the circumferential direction of the fixing member. In the drawing, the arrow E indicates the circumferential direction of the fixing member 201. FIG. 11B also corresponds to the conveyance direction of the recording medium.

The adhesive members divided into a plurality of members are provided obliquely to the circumferential direction of the fixing member 201. Further, for the adhesive member 301 divided into the plurality of parts, the inlet side of the fixing nip (the upstream side of the arrow F) is the axial end of the fixing member, and the outlet side of the fixing nip (the downstream side of the arrow F) is provided to be on the axial center side.

In the fixing device, in order to slide the high-thermal-conductive member 216 against the fixing belt 201 smoothly, a lubricant such as fluorine grease can be applied to the surface of the high-thermal-conductive member 216 on the fixing belt side. However, since the lubricant is in a liquid state when heated, the lubricant leaks from the axial end of the fixing belt 201 as it ages with the heating. The leaking of lubricant from the axial end of the fixing belt 201 reduces the amount of lubricant at the sliding portion and increases the frictional resistance of sliding, resulting in a problem of durability such as an increase in the load on the fixing belt 201.

On the other hand, according to the present embodiment, by forming the adhesive members 301 in the shape and arrangement as shown in FIGS. 11A and 11B, for example, the spread lubricant can be collected in the axial center, and the leaking of the lubricant from the axial end of the fixing belt 201 can be prevented.

The invention claimed is:

1. A fixing device, comprising:
a rotatable endless fixing member;
a pressure member provided on an outside of the fixing member and facing the fixing member;
a nip forming member provided inside the fixing member and forming a fixing nip between the fixing member and the pressure member;
a nip forming support member for supporting the nip forming member;
a high-thermal-conductive member provided between the fixing member and the nip forming member; and
an adhesive provided between the high-thermal-conductive member and the nip forming member,
wherein a thermal conductivity of the adhesive is larger than a thermal conductivity of the nip forming member and is lower than a thermal conductivity of the high-thermal-conductive member.

2. The fixing device according to claim 1, wherein the adhesive is provided only at both ends outside a maximum-sheet-passing area in the axial direction of the fixing member.

3. The fixing device according to claim 1, wherein the adhesive is provided outside a width of the fixing nip in a circumferential direction of the fixing member and is provided only on an inlet side of the fixing nip.

4. The fixing device according to claim 1, wherein the adhesive is provided outside a width of the fixing nip in a circumferential direction of the fixing member, and only on an exit side of the fixing nip.

5. The fixing device according to claim 1, further comprising
a fixing heat source, the fixing heat source being a halogen heater having, in an axial direction of the fixing member, a first portion where a winding of a filament is dense and a second portion where the winding of the filament is sparse,
wherein a thickness of a first portion of the adhesive facing the first portion of the filament where the winding of the filament is dense is larger than a thickness of a second portion of the adhesive facing the second portion of the filament where the winding of the filament is sparse.

6. The fixing device according to claim 1, wherein the adhesive is divided into a plurality of parts in an axial direction of the fixing member, the plurality of parts of the adhesive being arranged obliquely with respect to the circumferential direction of the fixing member.

7. An image forming apparatus including the fixing device of claim 1.

8. A heating device, comprising:
a rotatable endless fixing member;
a nip forming member provided inside the fixing member and forming a fixing nip between the fixing member and a pressure member;
a nip forming support member for supporting the nip forming member;
a high-thermal-conductive member provided between the fixing member and the nip forming member; and
an adhesive provided between the high-thermal-conductive member and the nip forming member,
wherein a thermal conductivity of the adhesive is larger than a thermal conductivity of the nip forming member and is lower than a thermal conductivity of the high-thermal-conductive member.

9. The heating device according to claim 8, wherein the adhesive is provided only at both ends outside a maximum-sheet-passing area in the axial direction of the fixing member.

10. The heating device according to claim 8, wherein the adhesive is provided outside a width of the fixing nip in a circumferential direction of the fixing member and is provided only on an inlet side of the fixing nip.

11. The heating device according to claim 8, wherein the adhesive is provided outside a width of the fixing nip in a circumferential direction of the fixing member, and only on an exit side of the fixing nip.

12. The heating device according to claim 8, further comprising a fixing heat source, the fixing heat source being a halogen heater having, in an axial direction of the fixing member, a first portion where a winding of a filament is dense and a second portion where the winding of the filament is sparse, wherein a thickness of a first portion of the adhesive facing the first portion of the filament where the winding of the filament is dense is larger than a thickness of a second portion of the adhesive facing the second portion of the filament where the winding of the filament is sparse.

13. The heating device according to claim 8, wherein the adhesive is divided into a plurality of parts in an axial direction of the fixing member, the plurality of parts of the adhesive being arranged obliquely with respect to the circumferential direction of the fixing member.

14. A device to be included in a fixing device having a rotatable endless fixing member, the device comprising:

a nip forming member to form a fixing nip between the fixing member and a pressure member;

a high-thermal-conductive member provided between the fixing member and the nip forming member; and an adhesive provided between the high-thermal-conductive member and the nip forming member, wherein a thermal conductivity of the adhesive is larger than a thermal conductivity of the nip forming member and is lower than a thermal conductivity of the high-thermal-conductive member.

15. The device according to claim 14, wherein the adhesive is provided only at both ends outside a maximum-sheet-passing area in the axial direction of the fixing member.

16. The device according to claim 14, wherein the adhesive is provided outside a width of the fixing nip in a circumferential direction of the fixing member and is provided only on an inlet side of the fixing nip.

17. The device according to claim 14, wherein the adhesive is provided outside a width of the fixing nip in a circumferential direction of the fixing member, and only on an exit side of the fixing nip.

18. The device according to claim 14, wherein the adhesive is divided into a plurality of parts in an axial direction of the fixing member, the plurality of parts of the adhesive being arranged obliquely with respect to the circumferential direction of the fixing member.

* * * * *